US005618130A

United States Patent [19]

Flint

[11] Patent Number: 5,618,130

[45] Date of Patent: Apr. 8, 1997

[54] ROADWAY MARKER AND METHOD OF APPLYING A QUANTUM OF ADHESIVE TO THE BOTTOM SURFACE OF THE MARKER

[76] Inventor: Theodore R. Flint, P.O. Box 50, Elverson, Pa. 19520

[21] Appl. No.: 500,198

[22] Filed: Jul. 10, 1995

[51] Int. Cl.[6] ..... E01F 9/06

[52] U.S. Cl. ..... 404/12; 404/16; 366/337; 116/63 R

[58] Field of Search ..... 404/9, 11, 12, 404/13, 14, 16; 405/259.5, 259.6; 366/337; 116/63 R

[56] References Cited

U.S. PATENT DOCUMENTS

| | | | |
|---|---|---|---|
| 2,371,462 | 3/1945 | Nicholson | 404/15 |
| 2,708,858 | 5/1955 | De Shazor, Jr. | 404/16 |
| 3,096,694 | 7/1963 | Lynn | 404/12 |
| 3,332,327 | 7/1967 | Heenan | 404/16 |
| 3,392,639 | 7/1968 | Heenan et al. | 404/12 |
| 3,485,148 | 12/1969 | Heenan | 404/12 |
| 3,758,191 | 9/1973 | Hedgewick | 359/531 |
| 3,785,719 | 1/1974 | Jonnes | 359/538 |
| 3,936,208 | 2/1976 | Baynes et al. | 404/16 |
| 3,954,346 | 5/1976 | Miller | 404/16 |
| 4,237,191 | 12/1980 | Horne | 359/551 |
| 4,681,401 | 7/1987 | Wyckoff | 359/536 |
| 4,717,281 | 1/1988 | Shepherd et al. | 404/16 |
| 4,952,068 | 8/1990 | Flint | 366/337 |
| 5,098,228 | 3/1992 | Mauthe | 405/259.6 |
| 5,310,278 | 5/1994 | Kaczmarczik et al. | 404/14 |
| 5,316,406 | 5/1994 | Wyckoff | 404/12 |
| 5,391,015 | 2/1995 | Kaczmarczik et al. | 404/14 |

FOREIGN PATENT DOCUMENTS

| | | | |
|---|---|---|---|
| 0053299 | 6/1982 | European Pat. Off. . | |
| 354333 | 2/1990 | European Pat. Off. | 404/13 |
| 1327759 | 8/1973 | United Kingdom . | |

*Primary Examiner*—Henry A. Bennett
*Assistant Examiner*—Pamela A. O'Connor
*Attorney, Agent, or Firm*—Eckert Seamans Cherin & Mellott

[57] ABSTRACT

A roadway marker or other article has a narrow slot through which a tab associated with a static mixing container is passed. Before placing the marker, the mixing container is drawn manually through the slot toward one side, thereby bursting internal seals or walls in the mixing container that separate two or more adhesive components, forcing the components to flow and mix, and finally to discharge the mixed adhesive onto the opposite surface of the marker in the correct mix proportions and quantity needed to attach the marker in place. The mixing container is flexibly collapsible and when initially containing the components has a larger cross section than the slot. A pull tab extends from the container for pulling the container though the slot or passageway. The container is structured such that the components are forced to mix and flow out of the compartments through the compartment outlets upon pulling the container by the pull tab through the passageway, which is dimensioned to constrict the container and may contain one or more rollers bearing on the container. The mixing portion has walls and/or passages and openings for mixing the components as they are forced toward a container outlet, for example dividing and recombining the stream. Upon pulling the container through the opening the components are mixed together along the flowpath and then forced to flow out of the container to be discharged onto the surface of the marker or the like adjacent to the slot passageway.

12 Claims, 4 Drawing Sheets

ROADWAY MARKER AND METHOD OF APPLYING A QUANTUM OF ADHESIVE TO THE BOTTOM SURFACE OF THE MARKER

BACKGROUND OF THE INVENTION

1. Field of the Invention

The invention relates to the adhesive attachment to pavement or the like, of roadway markers such as low reflectors, colored markers for hydrants or U-turn areas, etc. To achieve a rapid and effective attachment, a two part curable adhesive is provided in an elongated static mixing package arranged to be pulled manually through a slot in the marker, whereupon internal seals are ruptured in the package, allowing the adhesive and curing agent to proceed through mixing chambers in the package, and accurately mixing and discharging a quantity of curable adhesive onto a rear face of the marker such that the marker can be fixed in place.

2. Prior Art

Various forms of markers are known for attachment to pavement for providing location information, especially for the operators of vehicles. Often the markers contain reflectors, and some are distinctively colored. Some markers are intended to provide a vibrational signal to a driver that runs his or her wheels over the marker. Other markers may be placed adjacent to a fire hydrant or the like, and distinctively colored to provide firefighters with a quick way to find a nearby hydrant. Another use for markers is to delineate lanes, parking areas and so forth. Examples of such markers can be found, for example in the following U.S. patents:

| | |
|---|---|
| 2,371,462 | Nicholson |
| 2,708,858 | DeShazor, Jr. |
| 3,096,694 | Lynn |
| 3,332,327 | Heenan |
| 3,392,639 | Heenan, et al. |
| 3,485,148 | Heenan |
| 3,758,191 | Hedgewick |
| 3,785,719 | Jonnes |
| 3,936,208 | Baynes, et al. |
| 3,954,346 | Miller |
| 4,237,191 | Horne |
| 4,681,401 | Wyckoff |
| 5,310,278 | Kaczmarczik, et al. |
| 5,316,406 | Wyckoff |
| 5,391,015 | Kaczmarczik, et al. |

In addition, British patent 1,327,75—Medynski; and European patents 354,333 and 53,299, both to Silbernagel disclose markers of this type. Such Traffic markers typically comprise a low profile square or round block having sloping sides, and can be attached on the surface of the pavement using fasteners or with an adhesive such as road tar or bitumen. A quick and secure surface attachment is needed, preferably without the need to recess the surface of the roadway, and advantageously minimizing disruption of use of the roadway for traffic as well as maximizing the safety of the installer.

The traffic marker itself is advantageously formed of a molded hard rubber slab, although other materials are also possible. The slab can be integral or provided in parts, can carry reflectors or other visible distinctions, and may be flat on the underside or shaped or backed with material that assists in adhesive attachment or forms an enlarged area to be cemented to the surface.

The above patent to Lynn discloses a method of permanently applying guide markings to highways or jet runways, in which the markers are tetrafluorocarbon resin tiles, having etched or pitted bottoms for receiving a two-pan epoxy resin adhesive enabling markers to be securely affixed adhesively to the pavement surface. Holes can be provided around the periphery of the tile for improving adhesion, effectively forming cast epoxy rivets.

The above patents to Kaczmarczik, et al. concern applying a pavement marker to the pavement, in which method the pavement marker base is provided with an adhesive laminate comprising a two-layer pressure-sensitive adhesive, such as polyorganosiloxane pressure-sensitive adhesives, and a layer of deformable material such as foamed acrylic adhesive interposed between the first and second pressure-sensitive adhesive layers, and is applied to the pavement by contacting the pavement with the pressure-sensitive adhesive and applying pressure to the top layer to bond the pavement marker to the pavement. Alternatively, an adhesive surface can be foil covered, the foil being removed before pressing the marker into place, as in the foregoing European patents to Silbernagel.

Two component epoxy resin adhesives are particularly effective, but they can be difficult to use as a practical matter for roadway markers and the like, which often need to be quickly placed one after another along a line or the like, or placed in a roadway where traffic is a danger to the installer. The adhesive can be mixed together prior to installation, but immediately begins to cure. A slow cure adhesive may be insufficient to achieve a sufficient attachment before the marker is disturbed by a car or the like. A fast cure adhesive cannot be premixed is sufficient quantity to be used for a number of marker attachments. In addition, two component resin adhesives must be measured carefully, thoroughly mixed, and dispensed in the correct quantity, and preferably accurately placed, to achieve a secure mounting.

It would be advantageous if a fast curing two component resin adhesive could be mixed and deployed in a manner that is more convenient for the successive mounting of a plurality of successive road markers or other similar situations, in which it is not practical or convenient to premix the adhesive and apply it individually to each marker.

SUMMARY OF THE INVENTION

It is an object of the invention to provide a system for applying a measured amount of a composition, such as, for example, a multi-component adhesive, to a surface of an object, such as, for example, a roadway marker.

It is also an object to mix and apply a multi-component adhesive using a static mixing container that is structurally engaged with an object such as a roadway marker such that the mixing container can be drawn manually through an opening in the object to simultaneously mix and discharge the adhesive onto a surface of the object to be adhesively affixed to a surface.

According to an aspect of the invention, a roadway marker or the like is provided with a narrow slot through which a tab associated with the mixing container is passed. Just before placing the marker, the mixing container is drawn manually through the slot toward one side, thereby bursting internal seals or walls in the mixing container that separate the adhesive components, forcing the components to flow and mix, and finally to discharge the mixed adhesive onto the opposite surface of the marker in the correct mix proportions and quantity needed to attach the marker in place.

These and other objects and aspects are obtained using a package for at least two components of a composition, the package including a flexibly collapsible container defining a storage portion having walls defining at least two compartments, each containing one of the components to be mixed and each compartment including a compartment outlet. A pull tab extends from the container for pulling the container though the slot or passageway defined by an object. The passageway has a cross sectional area that initially is smaller than the cross sectional area of the container with the components therein. The container is structured such that the components are forced to mix and flow out of the compartments through the compartment outlets upon pulling the container by the pull tab though the passageway.

The container can include a container outlet or likewise can have a rupturable seal forming an outlet. A mixing portion of the container communicates with the compartment outlets and is placed between the storage portion and the container outlet. The mixing portion has walls and/or passages and openings defining a mixing flowpath structured for mixing the components, for example dividing and recombining the stream, such that upon pulling the container by the pull tab through the opening the components are mixed together along the flowpath and then forced to flow out of the container outlet onto the surface of the marker or the like adjacent the slot passageway.

The invention also encompasses a method of applying a measured amount of a composition having at least two components to a surface of an object, including providing a package for the composition including a collapsible container having a storage portion with separating walls initially defining at least two separated compartments, each containing one of the components and each including a compartment outlet that can have a rupturable seal, and providing a pull tab extending from the container. The pull tab is inserted through a passageway opening on the surface of the object, the passageway having a cross sectional area that is smaller than a cross sectional area of the container with the components therein. By drawing the container through the passageway by the pull tab, the components are forced to flow out of the compartments through the compartment outlets, thereby depositing the composition on the surface of the object.

Preferably, the method includes the step of mixing the components as they are forced out. The container thus can be a static mixing dispenser having a circuitous mixing path along which the components are mixed as they flow, while drawing the container forces the components through the compartment outlets and through a mixing path between the storage portion and an outlet of the package. Mixing and dispensing can be facilitated by providing rollers or the like along the opening in the object, or alternatively, the container can be pulled through a simple slot or other opening dimensioned to constrict the container and thereby to mix and force out the product.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

FIG. 7*a* illustrates insertion of a pull tab into a passageway of the marker. FIG. 7*b* shows the components of the composition being forced out of their respective compartments and into a mixing portion. FIG. 7*c* illustrates the mixed composition being mixed in a mixing portion of the container. FIG. 7*d* illustrates the mixed composition being forced out of the container and deposited onto a bottom surface of the marker. FIG. 7*e* shows the marker placed on a surface of the roadway.

DETAILED DESCRIPTION OF THE PREFERRED EMBODIMENTS

Figure 1:
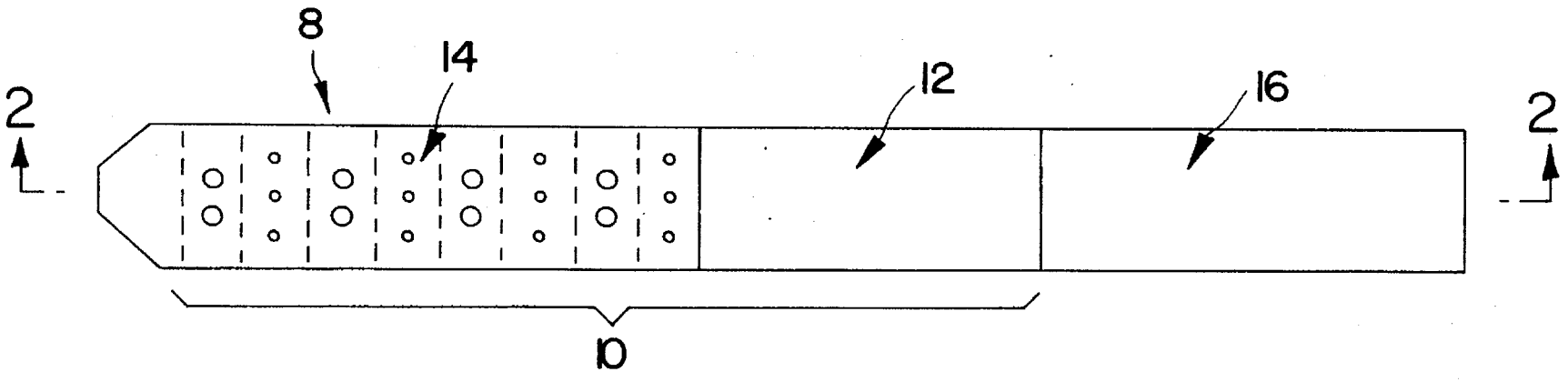
FIG. 1 is a plan view of a package according to the invention.
Figure 2:
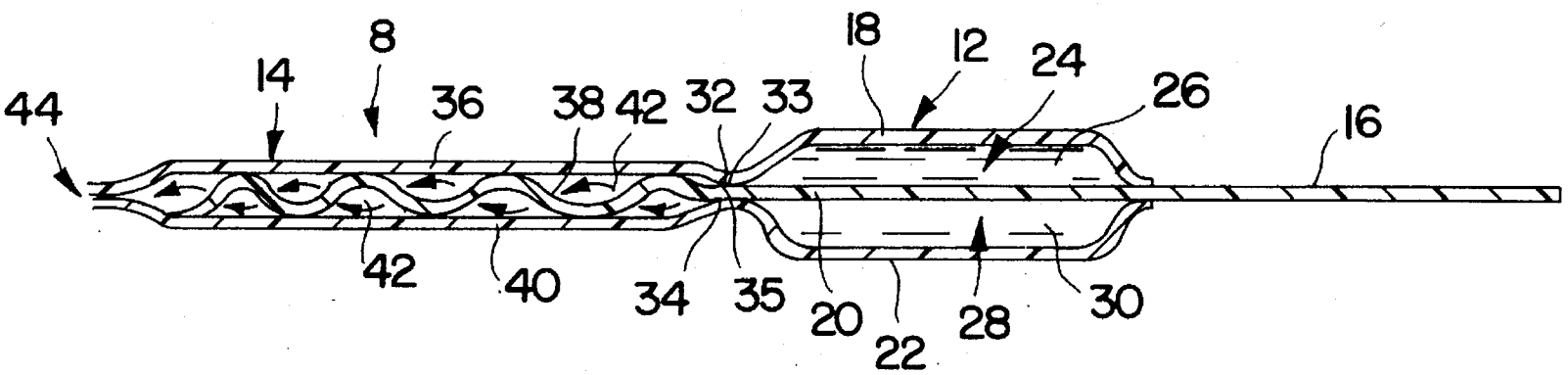
FIG. 2 is a sectional view through lines 2—2 of FIG. 1.

The system according to the invention for applying a quantum of adhesive to an object, such as a roadway marker, employs a package for the adhesive and the roadway marker, the package and the marker being adapted for use with one another. FIGS. 1–2 show an embodiment of an adhesive package according to the invention. The device includes a flexibly collapsible container 10, defining a storage portion 12 and a mixing portion 14. A pull tab 16 preferably extends from an end of the storage portion 12 located opposite the mixing portion 14. The storage portion 12 includes walls 18, 20, 22 defining at least two compartments, each containing a component of an adhesive composition to be mixed. For example, a first compartment 24 preferably contains a first component 26 of a two-component epoxy resin and a second compartment 28 defined by walls 20 and 22 contain the second component 30 of the two-part epoxy. The first compartment 24 includes a first compartment outlet 32 that communicates with the mixing portion 14. The second compartment includes a second compartment outlet 34 that similarly communicates with the mixing portion 14.

The mixing portion 14 includes walls 36, 38, 40 that define a flow path 42 that is structured for mixing the first component 26 and the second component 30. Examples of collapsible containers for flowable components of a composition that include static mixing portions can be found in U.S. Pat. No. 4,952,068, the disclosure of which is hereby incorporated. In general, the mixing portion includes a structure forming barriers to the movement of the components of the composition along the flow path 42 such that the components 26, 30 are forced along circuitous interconnecting paths. The components 26, 30 are mixed together as they flow from the storage portion to an outlet 44 of the container 10 along the flow path 42. U.S. Pat. No. 4,952,068 includes a description of preferred materials and modes of construction for such a flexible mixing container 10.

Pull tab 16 is preferably joined to an end of the storage compartment 12 remote from mixing portion 14. Pull tab 16 can be a rigid, semi-rigid, or flexible member. In the embodiments shown the pull tab comprises a simple strip; however, a loop or other structure for facilitating manual pulling is also possible.

Figure 3:
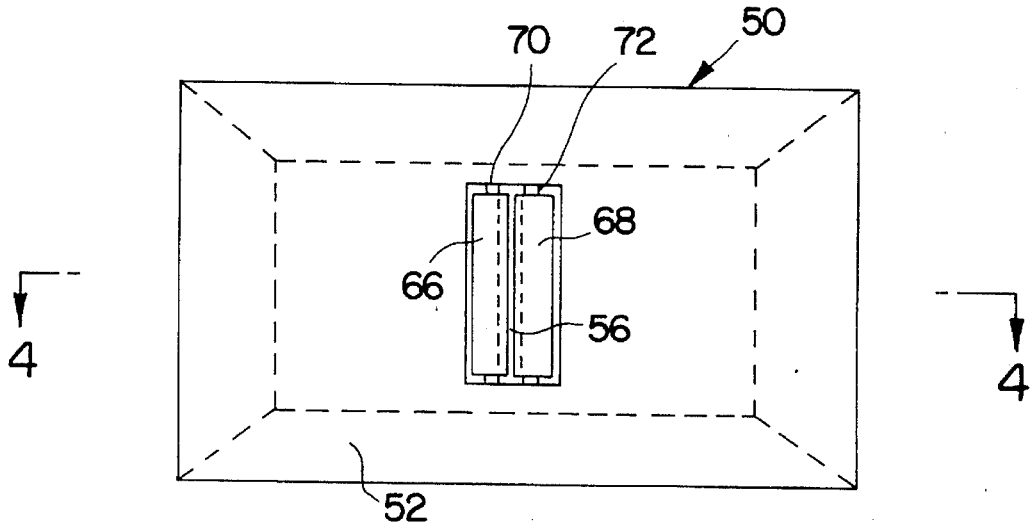
FIG. 3 is a bottom plan view of a roadway marker according to the invention.
Figure 4:
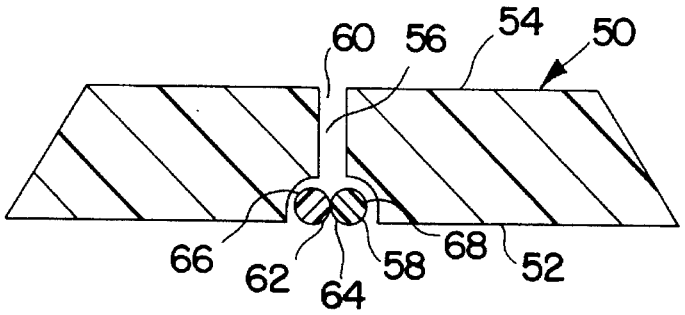
FIG. 4 is a sectional view through lines 4—4 of FIG. 3.

The invention is apt for quick and convenient application of fast curable adhesive to a roadway marker, and permits the adhesive to be accurately mixed and quickly applied in the precise quantity needed. FIGS. 3 and 4 show an exemplary roadway marker, generally indicated by numeral 50, which has been adapted for use with package 8 by the formation of a slot or passageway through which the mixing container can be drawn to effect kneading and mixing of the adhesive and to discharge adhesive onto the surface required. FIG. 3 shows the marker 50 in plan bottom view, and FIG. 4 is a sectional view through FIG. 3. Marker 50 has a bottom surface 52 that can be generally flat and an upper surface 54 that may include reflectors or other marking indicia and may be sloped or rounded. According to the invention, a passageway 56 is defined through the marker, the passageway 56 being structured and dimensioned to form a constriction such that the components 26, 30 are forced to flow out of the compartments 24, 28, respectively, through the compartment outlets 32, 34, respectively, upon pulling the container 10 through the passageway 56 by the pull tab 16.

In the embodiment illustrated in FIGS. 3 and 4, the passageway 56 extends between a first opening 58 in the bottom surface 52 and a second opening 60 in the top surface 54. The structure defining the passageway can include a pair of opposing surfaces 62, 64 defining a slot proximate the bottom surface 52. The opposing surfaces 62, 64 can be the surfaces, for example, of a pair of rollers 66, 68, or similar structures forming a constriction that assists in squeezing out the material in the container. Rollers 66, 68 or the like can be closely spaced on fixed axes such that pull tab 16 and the collapsed container 10 just pass between their surfaces 62, 64. Alternatively, the rollers can be somewhat free and disposed in a passageway 56 that becomes narrower transverse to the rotation axes of the rollers in the direction of pulling, in which case pulling the package urges the rollers toward one another to bear more tightly on the container. Rollers 66, 68 can be mounted on axles 70, 72, respectively, to permit them to rotate independently. Alternatively, one roller can be provided and arranged to cooperate with an opposite wall of passageway 56. As a further alternative, passageway 56 can be a simple slot having a given width or a narrowing slot that becomes smaller in the direction of pulling.

Figure 5:
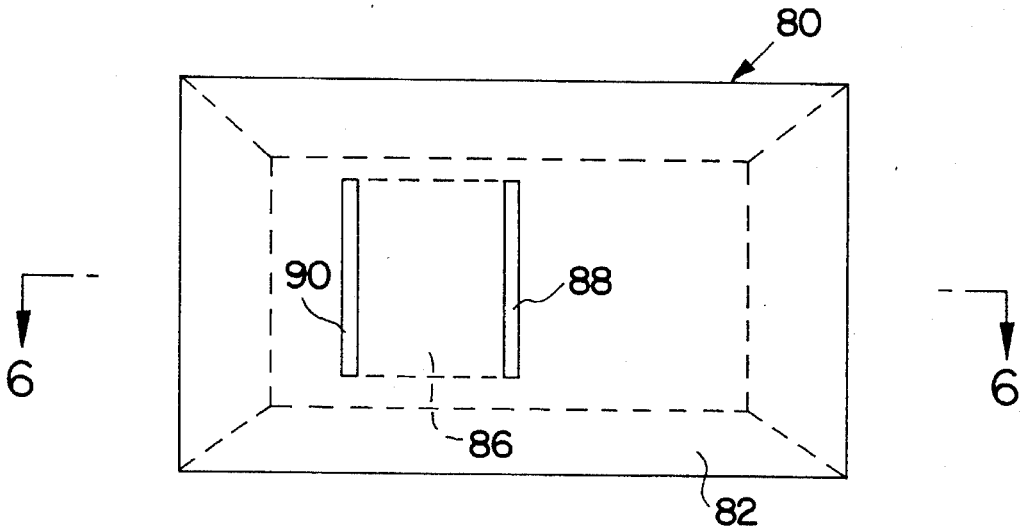
FIG. 5 is a bottom plan view of a second embodiment of a roadway marker according to the invention.
Figure 6:
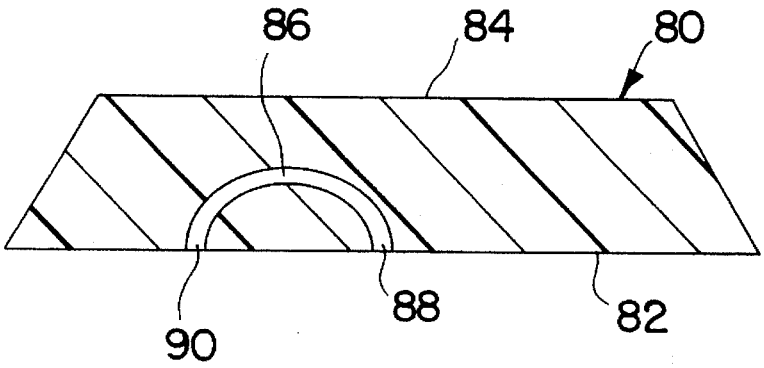
FIG. 6 is a sectional view through lines 6—6 of FIG. 5.
Figure 7A:
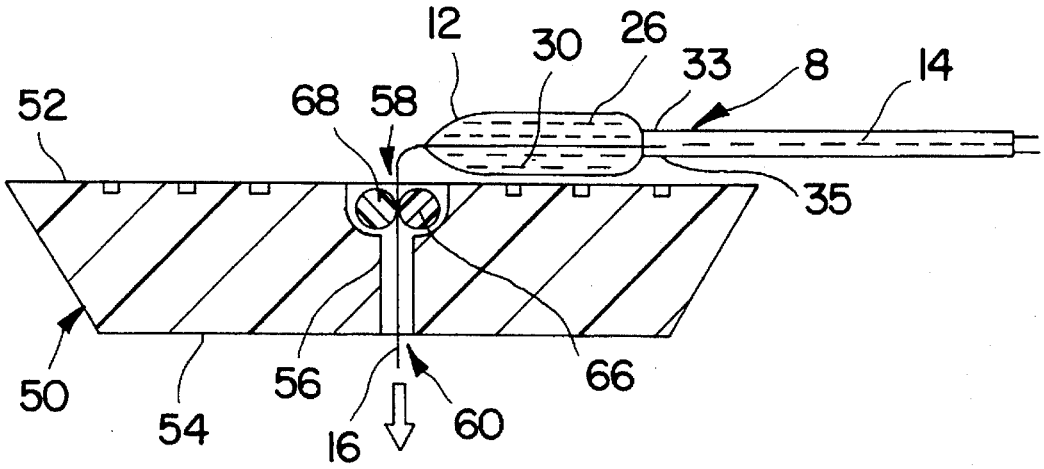
FIGS. 7*a* through 7*e* schematically illustrate, in sectional views, a method of marking a roadway using the package of FIGS. 1 and 2 with a third embodiment of a roadway marker.
Figure 7B:
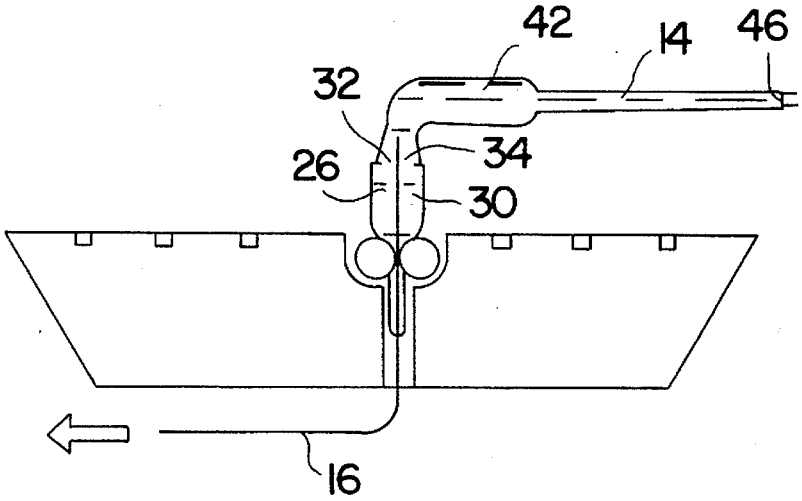
Figure 7C:
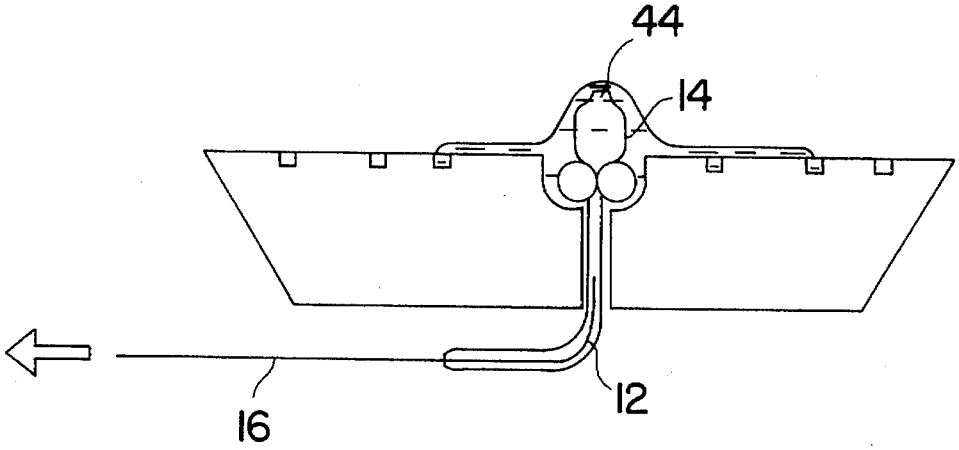
Figure 7D:
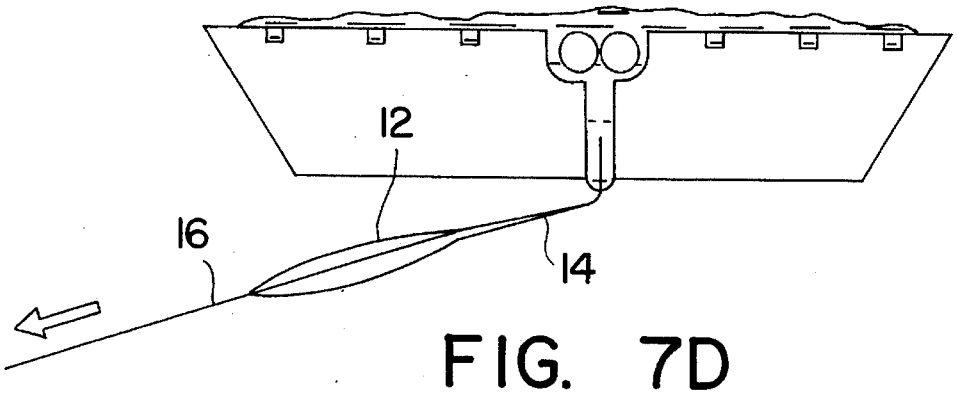
Figure 7E:
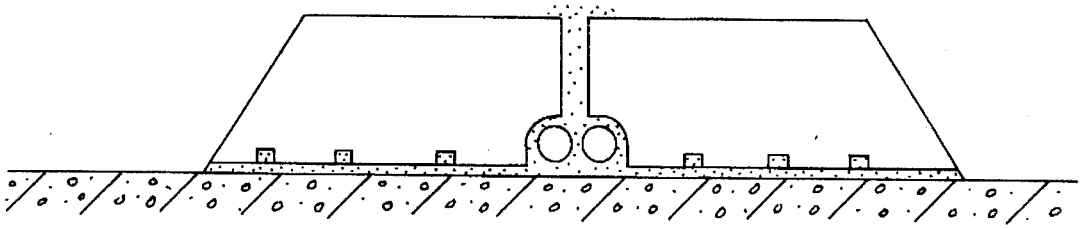

A second embodiment of a roadway marker 80 is illustrated in bottom plan view in FIG. 5 and in sectional view in FIG. 6. This marker also includes a generally flat bottom surface 82, an upper surface 84, and structure defining a passageway 86 having a first opening 88 at the bottom surface 82. The passageway 86 is preferably slot-shaped. In this embodiment, the passageway is arcuate and includes a second opening 90 that is also at the bottom surface 82. Thus in this embodiment the tab is pulled and the material is discharged on the same side of the marker, avoiding an opening on the upper surface of the marker.

FIGS. *7a–7e* illustrate the use of epoxy package 8 with roadway marker 50. The method includes the steps of providing the package 50 structured as described above, and the roadway marker 50, with the surfaces and passageway also as described. The pull tab 16 of the package 8 is inserted through opening 58 of passageway 56, the passageway having a passageway cross-sectional area that is smaller than a cross-sectional area of container 8 with its contents therein, such that the slot compresses the container to force the contents along. Container 8 is drawn through the passageway 56 manually using pull tab 16, thereby forcing the components 26, 30 to flow out of compartments 24, 26, respectively, and through the compartment outlets 32, 34, respectively. As components 26, 30 are forced out of the storage portion 12, they are introduced into mixing portion 14.

Openings 32, 34 can include rupturable walls or seals 33, 35, respectively, that separate the components initially. The seals are broken by internal pressure within compartments 24, 28 as storage portion 12 is squeezed between the opposing surfaces of rollers 66, 68. The first component 26 and the second component 30 are mixed together as they are forced to flow downstream along the flow path 42 between the compartment outlets 32, 34 and the container outlet 44. The container outlet 44 may also include a breakable seal that is forced open by the internal pressure within the mixing portion 14 as the mixing portion 14 is squeezed at the constriction formed by the passageway, e.g., between the surfaces of rollers 66, 68. By the time the components 26, 30 reach the end of the mixing portion 14 they are thoroughly mixed, for example by structures as provided in U.S. Pat. No. 4,952,068 for causing mixing of components with flow. The mixture 92 is squeezed out of the container opening 44 by continuing to pull the package 8 through the passageway 56, preferably by pulling the pull tab 16. An accurately mixed and measured amount of the mixture 92 is thereby deposited on the bottom surface 52 of the roadway marker 50.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

What is claimed is:

1. A system for marking a roadway, comprising:

a roadway marker that includes:

a bottom surface for fixing to a roadway surface;

an upper surface; and a through structure defining a passageway having a first opening at the bottom surface; and a package containing at least two components of an adhesive composition, the package including:

a collapsible container, including a storage portion having walls defining at least two compartments each containing one of the components and each compartment including a compartment outlet;

a pull tab extending from the container adapted for pulling the container though the passageway, the passageway being structured for forcing the components to flow out of the compartments through the compartment outlets upon pulling the container by the pull tab though the passageway.

2. The system of claim 1, wherein the container includes a container outlet and a mixing portion communicating with each of the compartments through the compartment outlets and positioned between the storage portion and the container outlet, the mixing portion having walls defining a flowpath structured for mixing the components, such that upon pulling the container by the pull tab through the passageway the components are mixed together along the flowpath and then forced to flow out of the container outlet.

3. The system of claim 1, wherein the compartment outlets are sealed by breakable seals.

4. The system of claim 1, wherein the container outlet is sealed by a breakable seal.

5. The system of claim 1, wherein the passageway is slot-shaped.

6. The system of claim 1, wherein the through structure includes a pair of rollers each having a roller surface opposing the roller surface of the other.

7. A method marking a roadway, comprising the steps of:

providing a package, including providing a collapsible container that comprises a storage portion having walls defining at least two compartments, each containing a component of an adhesive composition and each including a compartment outlet, and providing a pull tab extending from the container;

providing a roadway marker that comprises a bottom surface and structure defining a passageway extending from an opening in the bottom surface, the passageway having a cross sectional area that is smaller than a cross sectional area of the container;

inserting the pull tab through the opening into the passageway;

drawing the container through the passageway by the pull tab, including forcing the components to flow out of the compartments through the compartment outlets and thereafter onto the bottom surface; and applying the bottom surface to the roadway.

8. The method of claim 7, wherein the step of drawing the container further includes the step of mixing the components within a mixing portion of the container that communicates with each of the compartments through the compartment outlets and is positioned between the storage portion and an outlet of the package.

9. The system of claim 8, wherein the step of drawing the container further includes the step of breaking a seal located in each of the compartment outlets prior to forcing the components to flow.

10. The system of claim 8, wherein the step of drawing the container further includes a step of breaking a seal located in the outlet of the package after mixing the components.

11. The method of claim 8, wherein the step of drawing the container includes a step of passing the container between two rollers defining opposing surfaces of the passageway.

12. The method of claim 8, wherein the step of applying the bottom surface to the roadway includes the step of waiting a predetermined time for the adhesive to adhere the roadway marker to the roadway.

* * * * *